US011779092B2

(12) United States Patent
Louis

(10) Patent No.: US 11,779,092 B2
(45) Date of Patent: Oct. 10, 2023

(54) COLLAPSIBLE MIST STEAMER

(71) Applicant: SOTRO Innovations Inc., Brooklyn, NY (US)

(72) Inventor: Stephanie Louis, Brooklyn, NY (US)

( * ) Notice: Subject to any disclaimer, the term of this patent is extended or adjusted under 35 U.S.C. 154(b) by 0 days.

(21) Appl. No.: 17/658,329

(22) Filed: Apr. 7, 2022

(65) Prior Publication Data

US 2022/0322805 A1 Oct. 13, 2022

Related U.S. Application Data

(60) Provisional application No. 63/200,996, filed on Apr. 7, 2021.

(51) Int. Cl.
*A45D 19/16* (2006.01)

(52) U.S. Cl.
CPC ..... *A45D 19/16* (2013.01)

(58) Field of Classification Search
CPC ..... A45D 19/16
USPC ..... 4/537
See application file for complete search history.

(56) References Cited

U.S. PATENT DOCUMENTS 5,692,315 A * 12/1997 Sham ..... A45D 19/16 34/99
2015/0296953 A1* 10/2015 Murdock ..... A61K 8/92 424/70.28
2021/0007466 A1* 1/2021 Booker ..... B01D 53/04

* cited by examiner

*Primary Examiner* — Huyen D Le
(74) *Attorney, Agent, or Firm* — Lerner David LLP

(57) ABSTRACT

A collapsible mist steamer is provided herein. The collapsible mist steamer, notably, includes a plurality of sections connected by hinges configured to allow the collapsible mist steamer adopt a compact storage configuration and one or more use configurations. The collapsible mist steamer is useful for allowing a user to enjoy professional quality mist hair treatment in a setting of their choosing, using a highly portable device.

19 Claims, 10 Drawing Sheets

COLLAPSIBLE MIST STEAMER

CLAIM OF PRIORITY

This application claims priority to U.S. Provisional Patent Application No.: 63/200,996, filed Apr. 7, 2021, entitled "System for Training Use on Dexterous Tasks and Method of Use", the contents of which are hereby incorporated by reference in their entirety.

NOTICE OF COPYRIGHTS AND TRADE DRESS

A portion of the disclosure of this patent document contains material which is subject to copyright or trade dress protection. This patent document may show and/or describe matter that is or may become trade dress of the owner. The copyright and trade dress owner has no objection to the facsimile reproduction by anyone of the patent disclosure, as it appears in the Patent and Trademark Office patent files or records, but otherwise reserves all copyright and trade dress rights whatsoever.

FIELD OF THE EMBODIMENTS

The present invention relates generally to the field of hair treatment of existing art and more specifically relates to mist steamers for treating hair.

BACKGROUND

Doing things to one hair is not anything new. Since as early as the days of ancient Egypt, modifications to one's hair was being performed. Today, many various technologies exist to perform various hair treatments. However, these machines are often bulky and require a special-purpose area to house these machines. Storage and transport of such machines is often difficult and time consuming. Further, many people do not have the time or inclination to go to a salon or other specialized space for performing needed hair treatments, or do not find such spaces comfortable.

Therefore, there exists a need for a device that allows for salon-quality hair treatments from the comfort of one's home, or at another non-salon or barbershop setting that is convenient or comfortable to a user. Further, there exists a need for a device that is lightweight, compact, and portable, and thus allows for easy transport and storage. Finally, there exists a device that fulfills the above needs while being flexible enough to be used with a variety of users with different heights and body shapes, and in a variety of settings and situations. The present disclosure meets and exceeds this objective.

SUMMARY OF THE INVENTION

The present disclosure provides for a collapsible mist steamer, including a top member having a mist outlet. In an embodiment, the collapsible mist steamer includes an intermediate member, preferably connected to the top member by a first hinge. In an embodiment, the collapsible mist steamer includes a bottom member preferably connected to the intermediate member by a second hinge. In an embodiment, the bottom member includes a tank and a mist generator. In an embodiment, the collapsible mist steamer includes a hose attached to each of the top member and the bottom member and preferably configured to direct mist from the mist generator to the mist outlet. In an embodiment, the collapsible mist steamer includes a hood, the hood preferably configured to attach to the top member and contain mist expelled by the mist outlet. In a preferred embodiment, the first hinge and the second hinge are configured to allow the top member, the intermediate member, and the bottom member to collapse into a storage configuration in which each of the top member, the intermediate member, and the bottom member lie in parallel planes when each of the first hinge and the second hinge are closed. In a preferred embodiment, the first hinge and the second hinge are configured to allow the top member, the intermediate member, and the bottom member to adopt one or more use configurations when one or more of the first hinge and the second hinge are open.

In some embodiments, the one or more use configurations include a configuration for use on a floor, a configuration for use on a table, and a configuration for use on a raised platform at an intermediate height between a table and a floor.

In some embodiments, the top member includes a first cutout configured to attach to the hood and accept a head of a user.

In some embodiments, an interior of the first cutout includes a recess for attachment to the hood.

In some embodiments, a length of the top member is adjustable.

In some embodiments, the top member comprises a first top section and a second top section connected by a third hinge.

In some embodiments, the intermediate member comprises a second cutout.

In some embodiments, a length of the intermediate member is adjustable.

In some embodiments, each of the first cutout and the second cutout are configured to accept the tank when the collapsible mist steamer is collapsed into the storage configuration.

In some embodiments, the tank includes a fixed tank member and a removable tank member, the removable tank member preferably removably attached to one or more of the fixed tank member and the bottom member.

In some embodiments, the mist generator is disposed within the fixed tank member.

In some embodiments, the removable tank member comprises a protrusion configured to mate with the fixed tank member.

In some embodiments, the removable tank member is configured to contain a reservoir of fluid for use in generating mist.

In some embodiments, the bottom member includes a control panel, the control panel preferably configured to control at least mist duration and intensity.

In some embodiments, the hose is removably attachable from one or more of the top member and the bottom member.

In some embodiments, the mist outlet is disposed on a separate mist outlet member removably attached to the top member.

In some embodiments, the mist generator includes one or more of a heating member and an ultrasonic inducer.

In some embodiments, the bottom member includes a fan configured to force mist through the hose.

In some embodiments, the hood includes a rail configured to rest within the recess when the hood is attached to the first cutout.

The claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

Implementations may include one or a combination of any two or more of the aforementioned features or embodiments.

These and other aspects, features, implementations, and advantages can be expressed as methods, apparatuses, systems, components, program products, business methods, and means or steps for performing functions, or some combination thereof.

Other features, aspects, implementations, and advantages will become apparent from the descriptions, the drawings, and the claims.

BRIEF DESCRIPTION OF THE PREFERRED EMBODIMENTS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete, and fully conveys the scope of the present disclosure to those skilled in the art. In fact, it will be apparent to those skilled in the art that various modifications and variations can be made in the present invention without departing from the scope or spirit of the invention.

DETAILED DESCRIPTION OF THE PREFERRED EMBODIMENTS

Reference will now be made in detail to each embodiment of the present invention. Such embodiments are provided by way of explanation of the present invention, which is not intended to be limited thereto in any manner whatsoever. In fact, those of ordinary skill in the art may appreciate upon reading the present specification and viewing the present drawings that various modifications and variations can be made thereto.

For purposes of the present disclosure of the invention, unless specifically disclaimed, the singular includes the plural and vice-versa, the words "and" and "or" shall be both conjunctive and disjunctive, the words "any" and "all" shall both mean "any and all".

Figure 3:
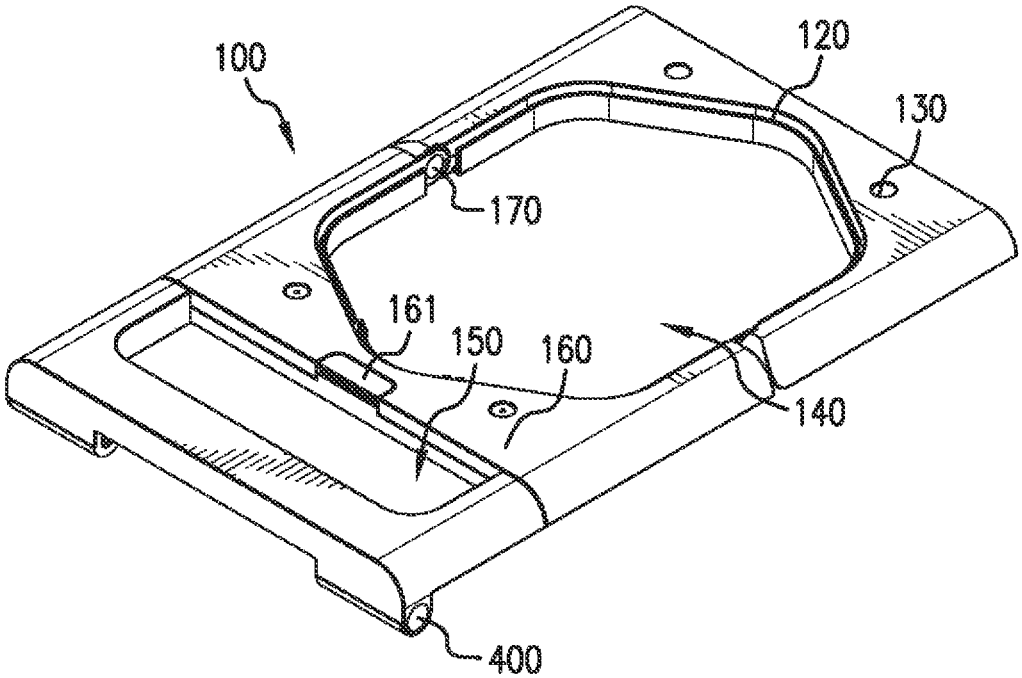
FIG. 3 is a top perspective viewing, showing an example embodiment of the top member of the collapsible mist steamer according to the present disclosure.
Figure 9:
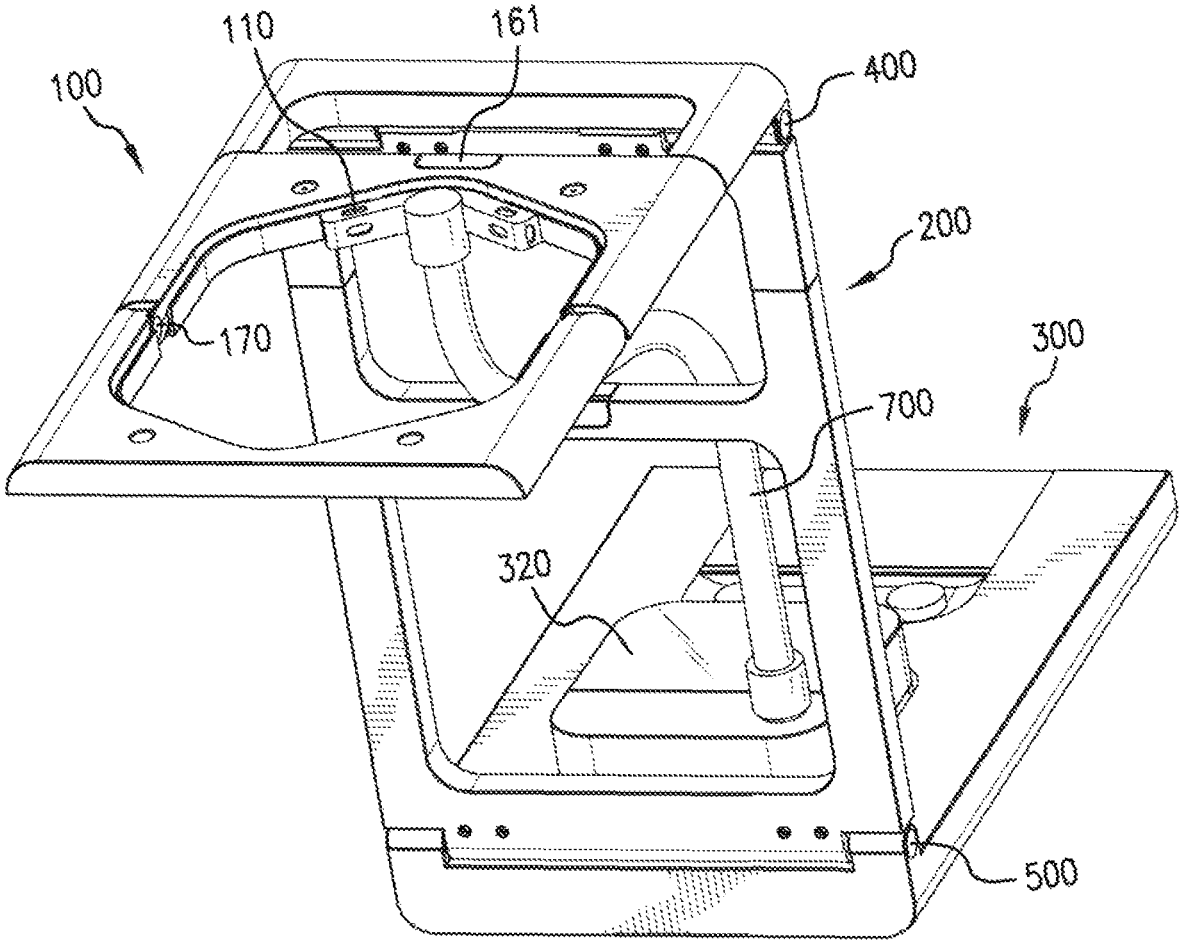
FIG. 9 is a front perspective viewing, showing an example embodiment of the collapsible mist steamer according to the present disclosure.

The present disclosure provides for a collapsible mist steamer including a top member 100 having a mist outlet 110, with reference to FIG. 3 and FIG. 9. The top member 100 includes a plurality of sides, with a top surface and a bottom surface extending therebetween. In some embodiments, the top member 100 includes a first cutout 140 configured to attach to a hood 600 and accept a head of a user, preferably where the first cutout 140 connects the top surface of the top member to the bottom surface of the top member. In preferable embodiments, the length of the top member is adjustable, by adjusting the length of one or more of the plurality of sides, to thereby increase the length of the top surface and the bottom surface. The adjustability of the length of the top member is useful for many reasons, including the need to adjust to a height of the user, or the user's head shape. In preferable embodiments, the top member includes a first top section and a second top section connected by a third hinge 170, more preferably such that the first top section and the second top section divide the top surface and the bottom surface into two parts, with the third hinge 170 marking the point of division. The third hinge 170 may be useful for adjusting the first cutout 140 to the shape and size of the user's head, as well as adjusting for the user's height. Preferably, the bottom section is aligned with the nape of the user's neck and the top section is pivoted away from the user's sightline and angled in the direction of the user's hairline when in use, and the third hinge 170 is useful to facilitate such functionality. In a preferable embodiment, the first cutout 140 is shaped in an oblong shape, more preferably in the form of an oblong hexagon. Such oblong shapes are preferred due to the oblong shape of a human head, but other shapes may be used with the device of the present disclosure as well.

The mist outlet 110 preferably includes one or more mist holes configured to allow a vaporized fluid, or admixture of fluid and gas to pass through. As used herein, "mist" includes such vaporized fluids or admixtures of fluid and gas. The mist outlet 110 may also be equipped with a diverter configured to direct mist in one or more desired directions. In preferable embodiments, the diverter may be removably attached to the mist outlet 110. In some embodiments, the diverter may include venturis, specially designed holes, specially designed nozzles, or other flow direction techniques known in the art, to aid in achieving a desired mist dispersion pattern. In some embodiments, the diverter may include a plurality of specialized diverters, each with a different dispersion pattern, depending on the needs of a user. In an embodiment, the mist outlet 110 is disposed on a separate mist outlet member removably attached to the top member 100.

Figure 4:
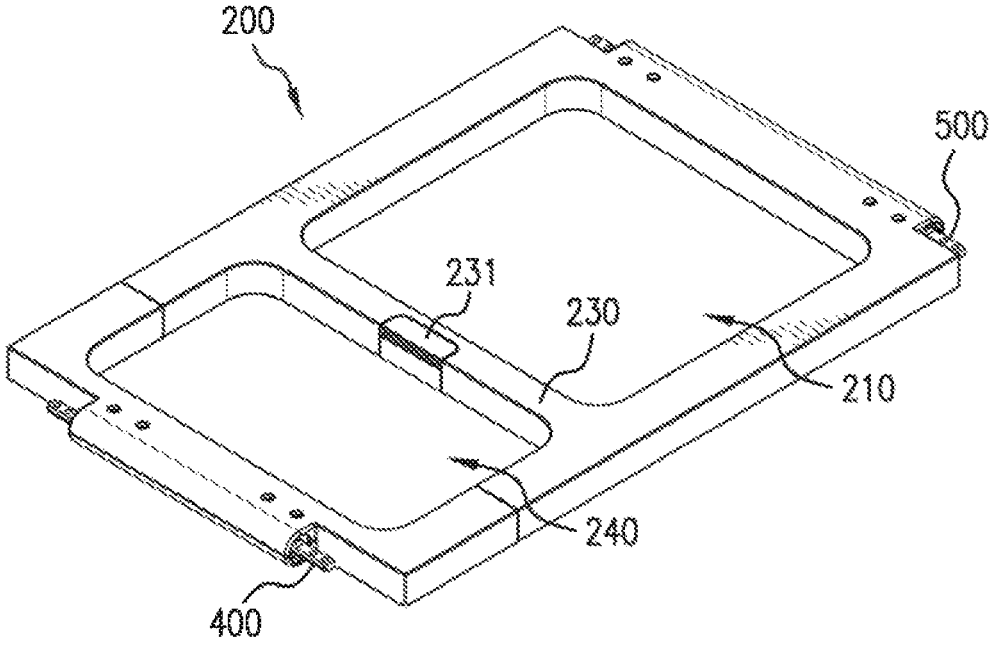
FIG. 4 is a top perspective viewing, showing an example embodiment of the intermediate member of the collapsible mist steamer according to the present disclosure.
Figure 5:
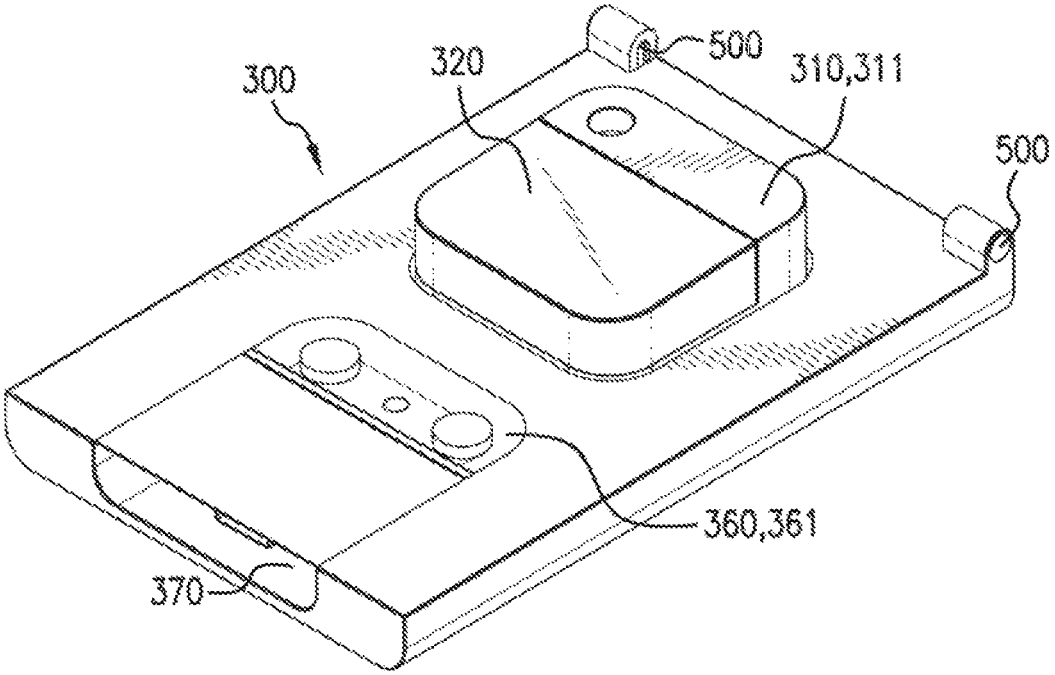
FIG. 5 is a top perspective viewing, showing an example embodiment of the bottom member of the collapsible mist steamer according to the present disclosure.

In an embodiment, the collapsible mist steamer includes an intermediate member 200, with reference to FIG. 4, preferably connected to the top member 100 by a first hinge 400. As used herein, "hinge" may mean an actual hinge, such as a friction hinge, but also may include other means of connecting separate parts that allow for functions equivalent to those described herein. Where used, friction hinges may have varying amounts of friction in different directions, and at different hinge locations, depending on the required properties of the device, and/or the needs of the user. Such friction settings may or may not be adjustable. Hinges may have any degree of freedom of movement, and are not limited to any particular angles in their open or closed configurations. The intermediate member 200 includes a plurality of sides, with a top surface and a bottom surface extending therebetween. In some embodiments, the intermediate member 200 includes a second cutout 210, preferably where the second cutout 210 connects the top surface of the intermediate member to the bottom surface of the intermediate member. In preferable embodiments, the length of the intermediate member 200 is adjustable, by adjusting the length of one or more of the plurality of sides, to thereby increase the length of the top surface and the bottom surface of the intermediate member. The adjustability of the length of the intermediate member 200 is useful for many reasons, including the need to adjust to a height of the user, or the user's head shape. In some embodiments, the top member 100 may include a third cutout 150, and in some embodiments, the intermediate member 200 may include a fourth cutout 220. In such embodiments, one or more of the top member 100 and the intermediate member 200 may include a top central arm 160 or an intermediate central arm 230 between the first cutout 140 and third cutout 150, or the second cutout 210 and fourth cutout 220, respectively. In exemplary embodiments, one or more of the top central arm 160 or the intermediate central arm 230 contains a mechanism for adjusting the length of either the top member or the intermediate member, respectively 161 and 231. The mechanism for adjusting the length of such members may include switches or buttons paired to locking mechanisms, as is well known in the art.

In an embodiment, the collapsible mist steamer includes a bottom member 300, with reference to FIG. 5-8, preferably connected to the intermediate member 200 by a second hinge 500, more preferably where the bottom member 300 includes one or more of a tank and a mist generator. In other embodiments, the tank and mist generator may be disposed on any other member, or may be completely separate from the disclosed members. However, preferably the tank and mist generator are disposed on the bottom member 300 for proper stability. The bottom member includes a plurality of sides, with a top surface and a bottom surface extending therebetween. In some embodiments, the mist generator may include one or more mist generation subcomponents 311 such as heating elements, ultrasonic transducers or equivalent components for atomizing a fluid or creating fluid/gas admixtures, temperature sensors, switches to prevent overheating/over temp, fans to direct the created mist, and others as are standard in the industry of salon style hair steamers or misters. In an exemplary embodiment, the heating element is capable of heating a fluid to the boiling temperature of water (212° F.) or more.

Figure 6:
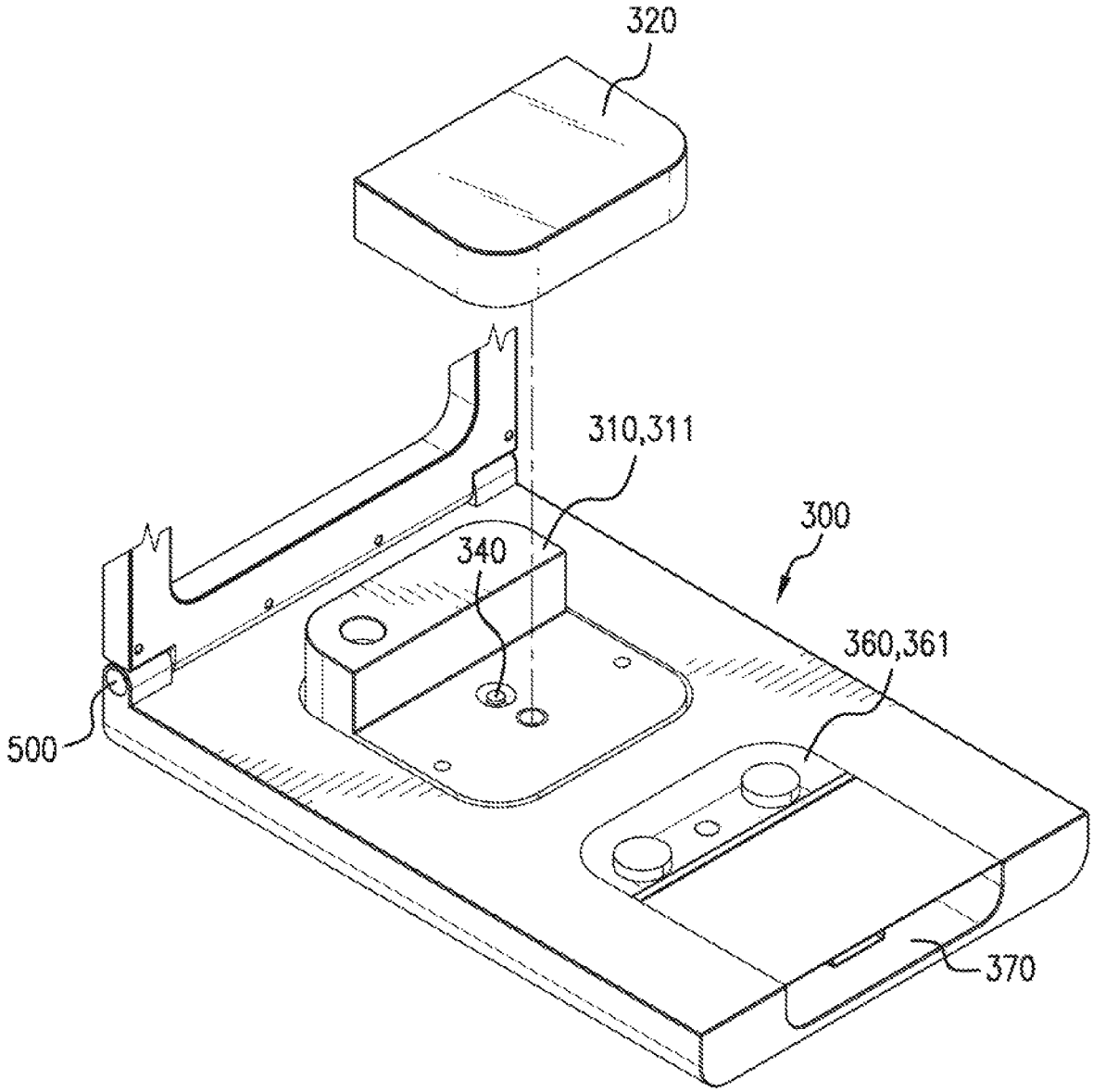
FIG. 6 is an alternate top perspective viewing, showing an example embodiment of the intermediate member of the collapsible mist steamer according to the present disclosure.
Figure 7:
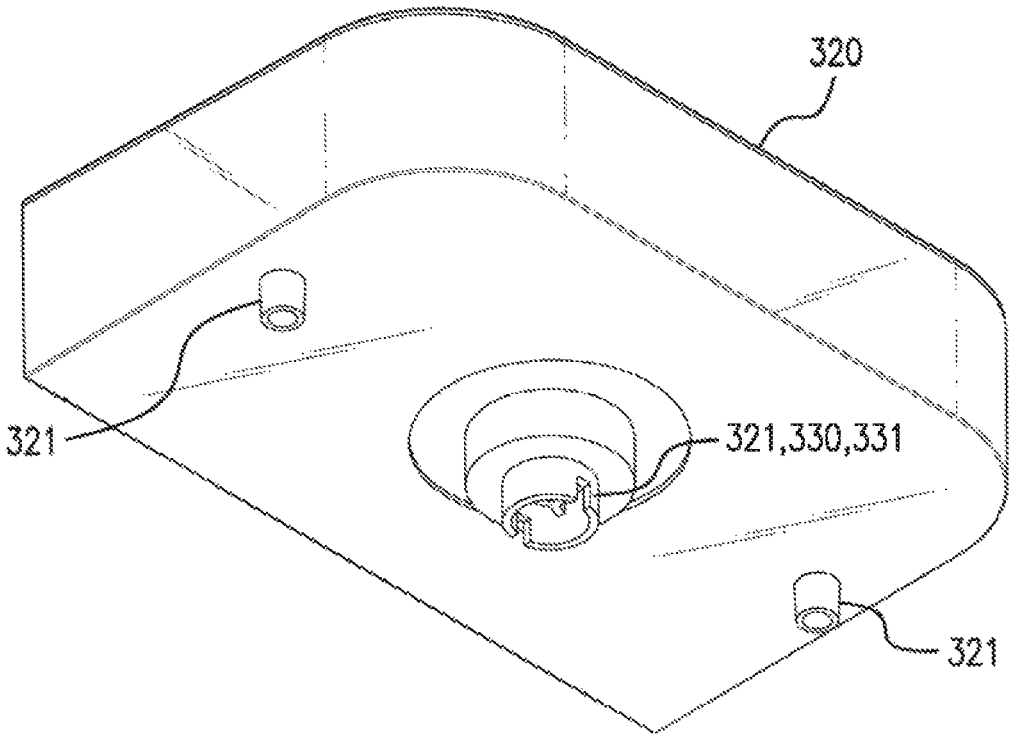
FIG. 7 is a bottom perspective viewing, showing an example embodiment of the removable tank member of the collapsible mist steamer according to the present disclosure.

In some embodiments, with reference to FIG. 6, the tank includes a fixed tank member 310 and a removable tank member 320, the removable tank member 320 removably attached to the fixed tank member 310 and the bottom member 300. Preferably, in such dual tank systems, the removable tank serves 320 as a fluid reservoir configured to hold a fluid for use in generating mist. In some embodiments, the removable tank member 320 may hold amounts of fluid from 0.25 L to 2 L, preferably from 0.5 L to 1.5 L, more preferably 0.75 L or 1 L. In some embodiments, the removable tank member 320 may hold amounts of fluid up to 5 L or greater. In some embodiments, the removable tank member 320 holds enough fluid for a mist steaming hair treatment session of between 1 to 3 hours, more preferably 1 to 2 hours. In some embodiments, supplementary removable tanks may be included so as to increase the available run time, and/or increase the available amount of fluid in reserve. In some embodiments, refilling of the removable tank member 320 is also possible to increase the available run time and/or refill the reserve of fluid. In an exemplary embodiment, the removable tank member 320 is composed of a material with significant heat deflection properties, preferably in excess of the boiling temperature of water (212° F.) as the removable tank member 320 may come into contact with such temperatures during the operation of the device. Fluids intended for use within the tank include, but are not limited to water, specialized fluids for use in hair care and/or treatment, essential oils, and combinations of the preceding.

In some embodiments, the mist generator is disposed within the fixed tank member 310. In some embodiments, with reference to FIG. 7, the removable tank member 320 includes a protrusion 321 configured to mate with a counterpart component on the fixed tank member 310. In some embodiments, the fixed tank member 310 includes a drain valve for draining residual fluid in the fixed tank member. In some embodiments, the removable tank member 320 includes a drain cap 330, disposed on the protrusion. In preferable embodiments, the drain cap 330 is removably attached to the removable tank member 320. In some embodiments, the drain cap 330 includes a spring-loaded sealing plunger 331 which is actuated by the counterpart component. In some embodiments, the drain cap 330 includes mechanisms, such as slots, configured to regulate fluid exchange with the fixed tank member 310, and/or regulate fluid level within the fixed tank member 310. In some embodiments, the counterpart component includes a plunger 340. The plunger 340 may include a spring loaded with a seal, preferably an elastomer seal. Such plunger 340 may, in some embodiments, be actuated by a separate component included in the fixed tank member 310.

Figure 8:
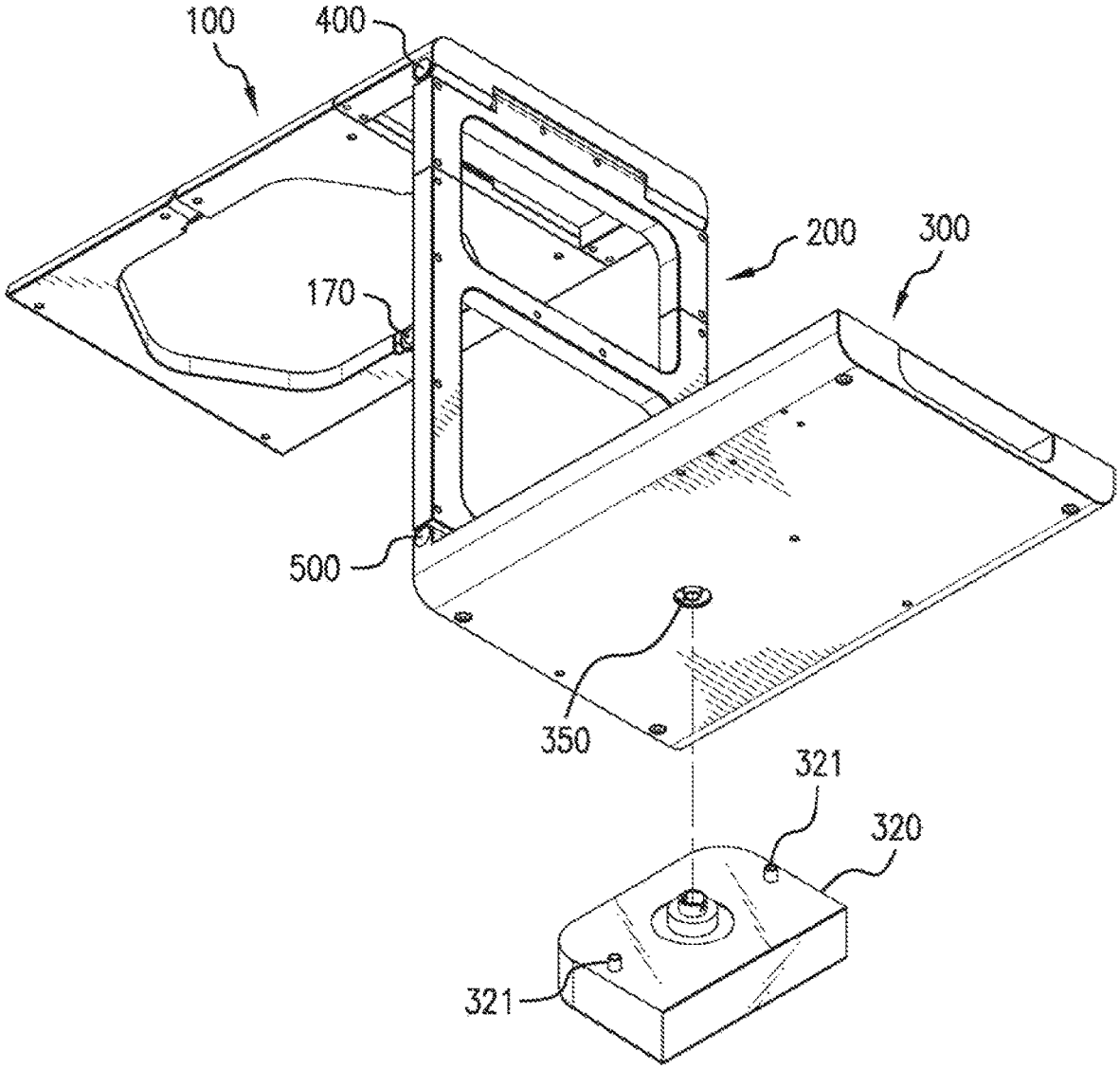
FIG. 8 is a bottom perspective viewing, showing an example embodiment of the collapsible mist steamer according to the present disclosure.

In some embodiments, with reference to FIG. 8, the bottom member 300 also includes a drain port 350, preferably disposed on the bottom surface of the bottom member. The drain port 350 may be configured to drain fluid from the fixed tank member 310, the removable tank member 320, or both. In an exemplary embodiment, the drain port 350 is configured to mate with the protrusion 321 on the removable tank member 320, and drain excess fluid directly into the removable tank member 320, for disposal or other use. The drain port 350 may be used to drain excess fluid from the collapsible mist steamer after use if the device is to be placed into long term storage, or otherwise moved, to prevent storage.

In some embodiments, the bottom member 300 includes one or more components necessary to provide or assist with functions useful in a collapsible mist steamer, including control electronics for the fixed tank member 310, power supplies, timers, fan controllers, temperature regulation circuitry, and safety interlock logic circuits. In some embodiments, the bottom member 300 includes a control panel 360, the control panel 360 configured to control at least one or more of mist duration and intensity, preferably where the control panel 360 includes control electronics 361 within configured to effect the desired functions of the control panel. In some embodiments, mist intensity is defined by a combination of several different parameters controlled by components of the collapsible mist steamer, including fan speed, (ultrasonic) inducer intensity, heating temperature, and others. In some embodiments, the bottom member 300 includes a bottom cutout 370 for use in storing a power cord or power supply equivalent, such as a power cord with a power block. In some embodiments, the bottom member 300 may include ballast or other weight adjustments in order to stabilize the collapsible mist steamer when in use.

In an embodiment, with reference to FIG. 9, the collapsible mist steamer includes a hose 700, preferably attached to each of the top member 100 and the bottom member 300, and more preferably configured to direct mist from the mist generator to the mist outlet 110. The hose 700 preferably is removably attachable to one or more of the top member 100 and the bottom member 300. In preferred embodiments, the hose 700 has advantageous material properties, such as flexibility, waterproofing, durability, and heat resistance. In some embodiments, the hose 700 is composed of a single piece, but in other embodiments, the hose 700 may be multiple pieces, or multiple separate hoses, depending on the needs of the device and/or user. In some embodiments, the bottom member 300 includes a fan configured to force mist through the hose 700, and through the mist outlet 110 at the top member 100. In an exemplary embodiment, the mist generator in the bottom member 300 and/or fixed tank member 310 generates mist which is directed into the hose 700 and forced by a fan through the mist outlet 110 in the top member 100.

Figure 10:
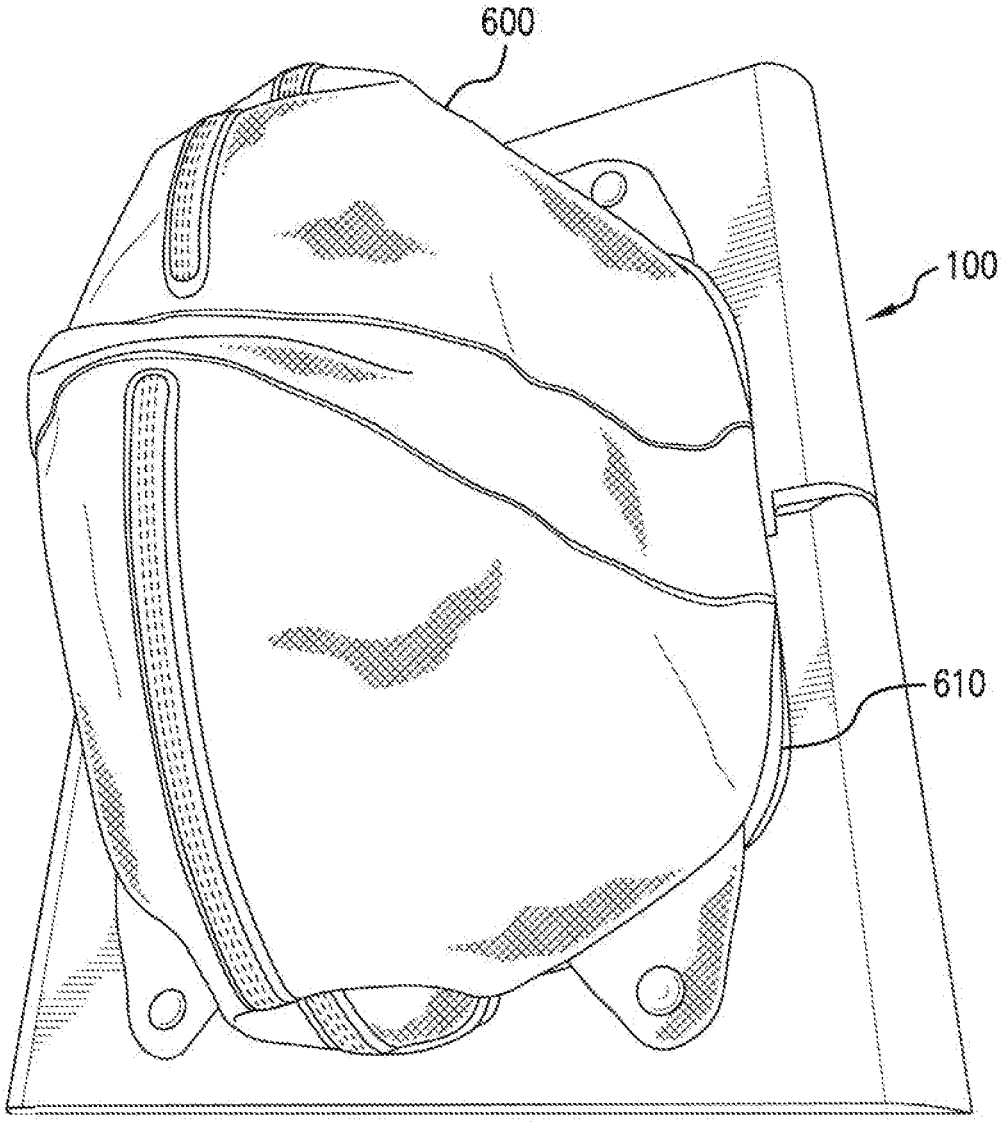
FIG. 10 is a top perspective viewing, showing an example embodiment of the hood and top member of the collapsible mist steamer according to the present disclosure.

In an embodiment, with reference to FIG. 10, the collapsible mist steamer includes a hood 600, preferably where the hood 600 is configured to attach to the top member 100 and contain mist expelled by the mist outlet 110. The hood 600 is most preferably configured to hold the expelled mist around the user's head during steam treatment. As a result, in conjunction with the desired portability of the present device, advantageous properties of the hood include: low weight, waterproofing, collapsibility, composition of semi-rigid components, and others. In some embodiments, the hood 600 includes a semi-rigid substructure. In some embodiments, the hood 600 includes features directed towards allowing the hood 600 to securely attach to the top member 100, and/or the first cutout 140, including one or more of snaps and/or attachments points 130, such as fabric snap fasteners, and a stiffened lip or rail 610. In some embodiments, the first cutout 140 includes a recess 120 configured for attachment to the hood 600, and preferably where the stiffened lip or rail 610 is designed to slot inside or rest within the recess 120 when the hood is attached to the top member 100 and/or first cutout 140.

Figure 2:
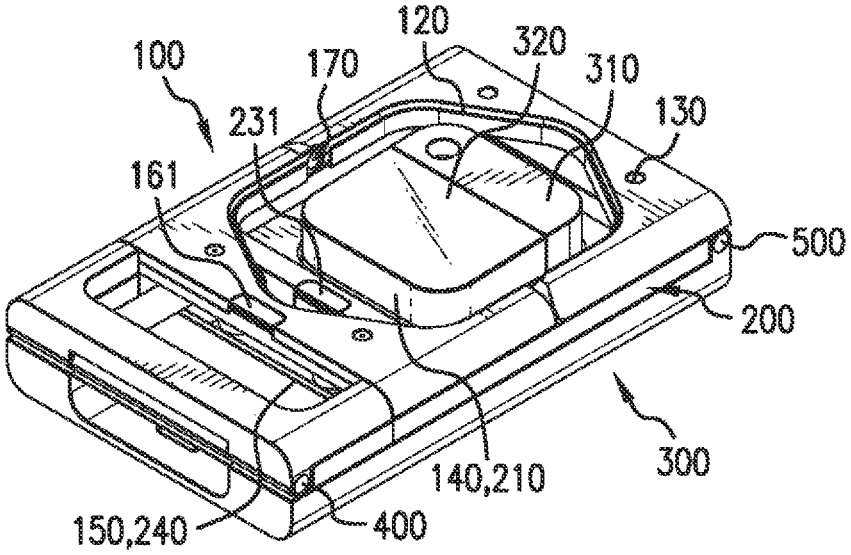
FIG. 2 is a top perspective viewing, showing an example folded and/or storage embodiment of the collapsible mist steamer according to the present disclosure.

In some embodiments, with reference to FIG. 2, the first hinge 400 and the second hinge 500 are configured to allow the top member 100, the intermediate member 200, and the bottom member 300 to collapse into a storage configuration in which each of the top member 100, the intermediate member 200, and the bottom member 300 lie in parallel planes when each of the first hinge 400 and the second hinge 500 are closed, and adopt one or more use configurations when one or more of the first hinge 400 and the second hinge 500 are open. The configurations of at least the first hinge 400 and the second hinge 500 (or more hinges if there are more than three sections), and the respective storage configurations may include or resemble one or more of the flattened configuration of: an accordion and/or "S" or "Z"-shaped fold, where the hinges are closed in alternating directions, and a "U"-shaped fold or roll fold, where the hinges are closed in the same direction.

Figure 1:
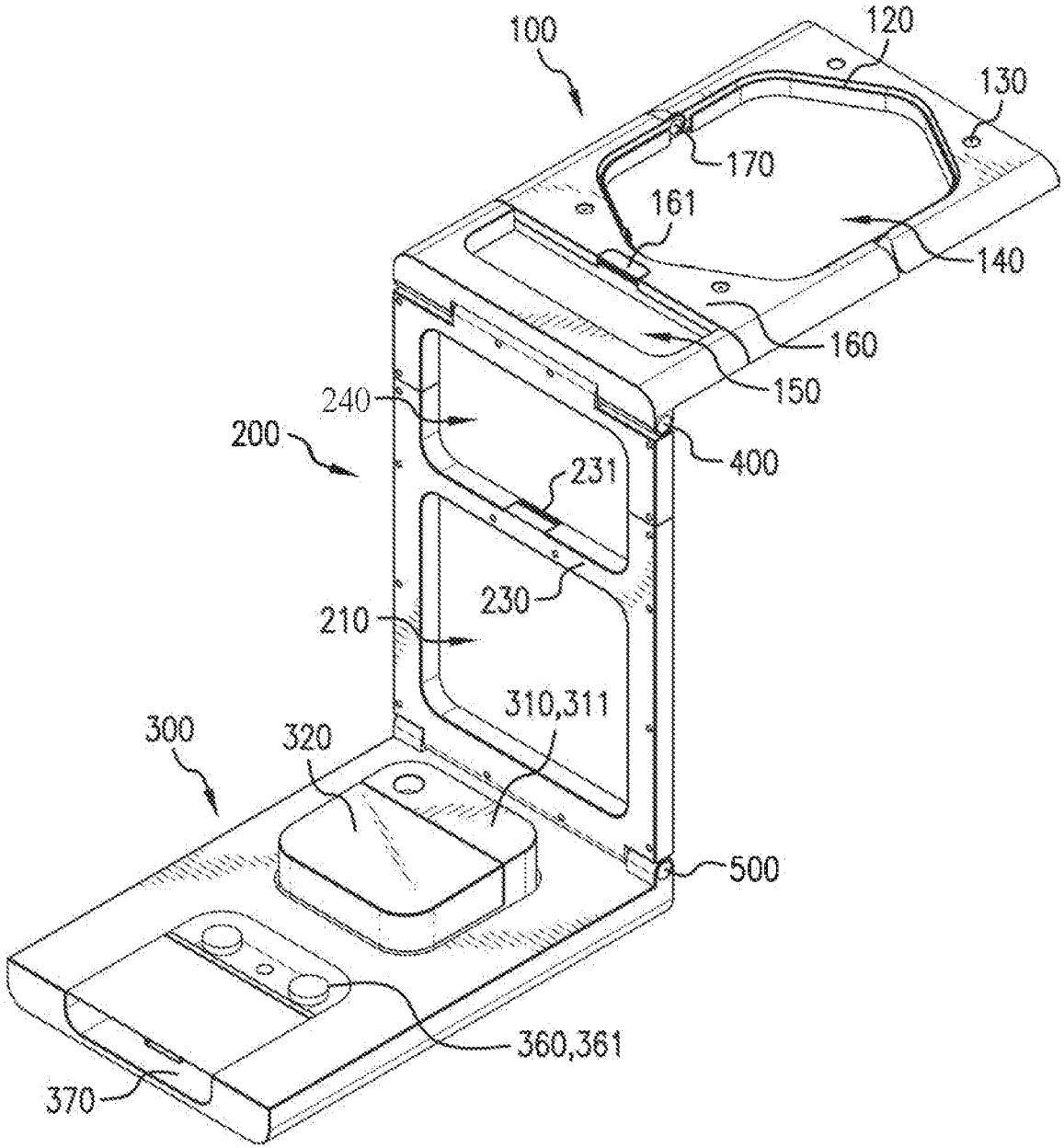
FIG. 1 is a top perspective viewing, showing an example unfolded embodiment of the collapsible mist steamer according to the present disclosure.

In some embodiments, with reference to FIG. 1, the one or more use configurations include a configuration for use on a floor, a configuration for use on a table, and a configuration for use on a raised platform at an intermediate height between a table and a floor. The one or more use configurations may involve some combination of opening and angling of each of the first 400, second 500, third 170, or more hinges, extension or contraction of the length of each of the top member 100 or intermediate member 200, and adjustment of positioning of the device relative to the user in order to adjust for factors such as the height of each of the table, raised platform, or floor relative to the height of the user, the shape of the user's head and/or body, the surface on which the user is seated, and associated properties of such seating surface, such as shape and height, and the properties of the surface of the table, raised platform, or floor on which the device is rested during use. Ideally, the designed features of the disclosed device are flexible enough to adjust to each of these factors, using engineering methods as known in the art. Although the collapsible mist steamer is preferably configured for use with a seated user, such as a seated user on a chair or couch or equivalent surface, use with a standing user or otherwise disposed user may also be contemplated.

As designed, the presently disclosed collapsible mist steamer is preferably intended to allow a user to treat their hair with professional-grade and/or cosmetology-approved tools over the user's entire head, while in a setting of their choosing, such as at the user's home, or any other non-salon or barbershop setting. Further, the device is designed to be highly portable and lightweight, particularly in its storage configuration, so that it may easily be moved between locations by a user. Ideally, the device is designed to fit easily within a carrying case, such as a standard carry-on suitcase.

In an embodiment, each of the first cutout 140 and the second cutout 210 are configured to accept the tank when the collapsible mist steamer is collapsed into the storage configuration. In such embodiments, the tank may protrude from the surface of the bottom member 300 to allow for greater volume of fluid in the tank, and thus each of the first cutout 140 and second cutout 210 may be sized and/or configured to accept this protrusion in the storage configuration so as to ensure that the size and/or height of the storage configuration is not significantly greater that the size and/or height of the bottom member including the tank, or the size and/or height of the top member 100, intermediate member 200, and bottom member 300 excluding the tank when stacked.

The collapsible mist steamer of the present disclosure is preferably made of materials with desirable lightweight, durability, and flexibility properties, such as polymers known in the art. Certain internal structures may be made of metals, other polymers, or composites, where greater stiffness, strength, durability, or other properties are required. For example, extendable guides used in conjunction with the length adjustment features of the top member 100 and/or intermediate member 200 may be made of metals, polymers, and or composite materials, as appropriate, due to the increased stiffness, strength, and/or durability required of such components. Rigid light-weight materials may be preferably used in the top member 100 and/or intermediate member 200 to prevent flexing in the device and/or destabilization of the device when under full extension and/or load from the hose 700 and/or hood 600 attachment. As previously noted, the bottom member 300 may also have ballast or other weight adjustments in order to ensure that the device is stabilized no matter if the bottom member is disposed below, at the same height, or above the user, or at any height between the stated heights, when in use.

In some embodiments, the collapsible mist steamer may also include self-disinfecting and/or sanitizing functions, similar to those known in the art. The hood 600 may be designed to aid in such function by being removable and separately washable.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," and "third," are used herein to describe various elements, components, regions, layers and/or sections, these elements, components, regions, layers and/or sections should not be limited by these terms. These terms are only used to distinguish one element, component, region, layer and/or section from another element, component, region, layer and/or section. Thus, a "first element," "component," "region," "layer" and/or "section" discussed below could be termed a second element, component, region, layer and/or section without departing from the teachings herein.

Features illustrated or described as part of one embodiment can be used with another embodiment and such variations come within the scope of the appended claims and their equivalents. Implementations may also include one or a combination of any two or more of the aforementioned features or embodiments.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

As the invention has been described in connection with what is presently considered to be the most practical and various embodiments, it is to be understood that the invention is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose the invention, including the best mode, and also to enable any person skilled in the art to practice the invention, including making and using any devices or systems and performing any incorporated methods. The patentable scope of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

The disclosure is illustrated throughout the written description. It should be understood that numerous variations are possible while adhering to the inventive concept. Such variations are contemplated as being a part of the present disclosure.

What is claimed is:

1. A collapsible mist steamer, comprising:

a top member having a mist outlet;

an intermediate member connected to the top member by a first hinge;

a bottom member connected to the intermediate member by a second hinge, the bottom member comprising a tank and a mist generator;

a hose attached to each of the top member and the bottom member and configured to direct mist from the mist generator to the mist outlet; and a hood, the hood configured to attach to the top member and contain mist expelled by the mist outlet, wherein the first hinge and the second hinge are configured to allow the top member, the intermediate member, and the bottom member to collapse into a storage configuration in which each of the top member, the intermediate member, and the bottom member lie in parallel planes when each of the first hinge and the second hinge are closed, and adopt one or more use configurations when one or more of the first hinge and the second hinge are open.

2. The collapsible mist steamer of claim 1, wherein the one or more use configurations include a configuration for use on a floor, a configuration for use on a table, and a configuration for use on a raised platform at an intermediate height between a table and a floor.

3. The collapsible mist steamer of claim 1, wherein the top member comprises a first cutout configured to attach to the hood and accept a head of a user.

4. The collapsible mist steamer of claim 3, wherein an interior of the first cutout comprises a recess for attachment to the hood.

5. The collapsible mist steamer of claim 4, wherein the hood comprises a rail configured to rest within the recess when the hood is attached to the first cutout.

6. The collapsible mist steamer of claim 3, wherein a length of the top member is adjustable.

7. The collapsible mist steamer of claim 3, wherein the intermediate member comprises a second cutout.

8. The collapsible mist steamer of claim 7, wherein each of the first cutout and the second cutout are configured to accept the tank when the collapsible mist steamer is collapsed into the storage configuration.

9. The collapsible mist steamer of claim 1, wherein the top member comprises a first top section and a second top section connected by a third hinge.

10. The collapsible mist steamer of claim 1, wherein a length of the intermediate member is adjustable.

11. The collapsible mist steamer of claim 1, wherein the tank comprises a fixed tank member and a removable tank member, the removable tank member removably attached to the fixed tank member and the bottom member.

12. The collapsible mist steamer of claim 11, wherein the mist generator is disposed within the fixed tank member.

13. The collapsible mist steamer of claim 11, wherein the removable tank member comprises a protrusion configured to mate with the fixed tank member.

14. The collapsible mist steamer of claim 11, wherein the removable tank member is configured to contain a reservoir of fluid for use in generating mist.

15. The collapsible mist steamer of claim 1, wherein the bottom member further comprises a control panel, the control panel configured to control at least mist duration and intensity.

16. The collapsible mist steamer of claim 1, wherein the hose is removably attachable from one or more of the top member and the bottom member.

17. The collapsible mist steamer of claim 1, wherein the mist outlet is disposed on a separate mist outlet member removably attached to the top member.

18. The collapsible mist steamer of claim 1, wherein the mist generator comprises one or more of a heating member and an ultrasonic inducer.

19. The collapsible mist steamer of claim 1, wherein the bottom member further comprises a fan configured to force mist through the hose.

* * * * *